United States Patent [19]

May

[11] 4,180,906

[45] Jan. 1, 1980

[54] RAZOR WITH ORBITING DISCS WITH SHARP-EDGE SLOTS, AND METHOD FOR MAKING DISCS

[76] Inventor: Russell P. May, 109 First Ave., Indialantic, Fla. 32903

[21] Appl. No.: 847,413

[22] Filed: Oct. 31, 1977

[51] Int. Cl.[2] ..... B26B 19/00

[52] U.S. Cl. ..... 30/42; 30/43.3; 30/346.51; 30/346.57

[58] Field of Search ..... 30/32, 42, 43.3, 43.4, 30/43.5, 346.5, 346.51, 346.57

[56] References Cited

U.S. PATENT DOCUMENTS

| | | | |
|---|---|---|---|
| 2,077,805 | 4/1937 | Muros | 30/43.3 |
| 2,592,146 | 4/1952 | Hvid | 30/346.51 X |
| 2,619,719 | 12/1952 | Schaufelberger | 30/346.51 X |
| 3,919,770 | 11/1975 | Sakai et al. | 30/346.51 X |
| 3,921,270 | 11/1975 | Upton | 30/43.3 |

*Primary Examiner*—Watson, Robert C.

[57] ABSTRACT

Discs having narrow, sharp-edge slots are orbited so that their slot edges undergo a slicing motion.

7 Claims, 6 Drawing Figures

FIG. 1
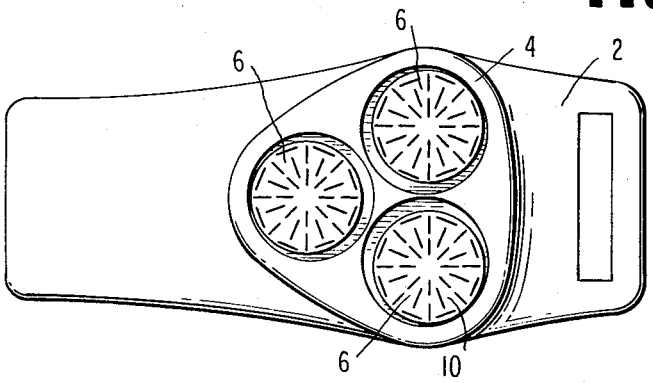
FIG. 3
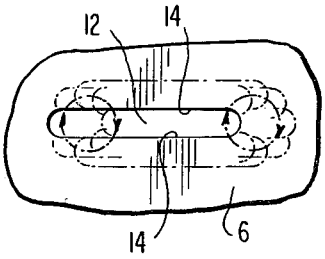
FIG. 2
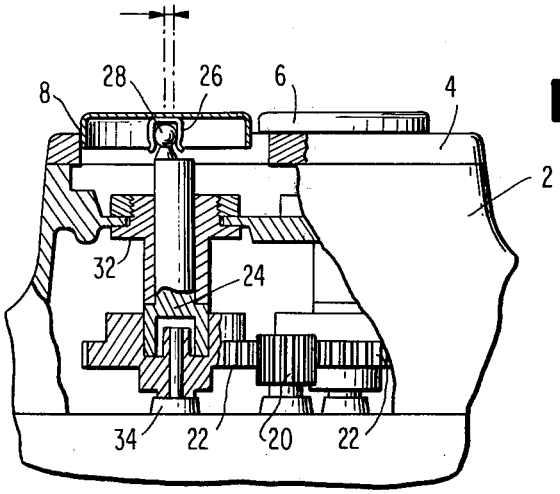
FIG. 4
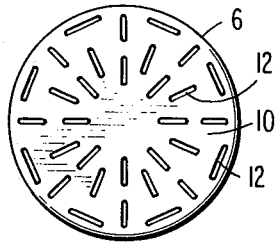
FIG. 5
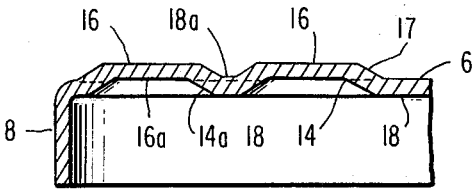
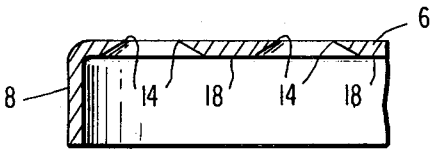
FIG. 6

RAZOR WITH ORBITING DISCS WITH SHARP-EDGE SLOTS, AND METHOD FOR MAKING DISCS

FIELD OF INVENTION

Cutlery, razors, with blade-moving means.

OBJECTS

The primary object of this invention is to provide a razor having one or more flat discs, preferably circular, adapted to be held flatwise against the face and having a plurality of narrow, sharp-edged slots, preferably only a few hundredths of an inch wide, and an eccentric drive which causes the disc to rapidly undergo an orbiting, non-rotary, eccentric motion approximately equal to or slightly greater than the width of the slots. By this means, the slot edges make a varying slicing stroke so as to slice off whiskers without slicing off the adjacent skin.

Another object is to provide for making the discs with sharp-edge slots whereby the discs can be manufactured by mass production methods without hand labor. According to this method, small ridges are stamped or forged in the disc metal so that the ridges up-stand on one side of the disc. Then the ridges are ground off, leaving sharp-edge slots where the ridges were. Subsequently, the metal can be tempered and hardened and honed according to standard blade-forming techniques.

These and other objects will be apparent from the following specification and drawing in which:

FIG. 1 is a plan view of a typical razor incorporating the invention;

FIG. 2 is a side elevation of the razor of FIG. 1, broken away to show the eccentric drive;

FIG. 3 is a diagram of a single slot illustrating the orbital movement;

FIG. 4 is a plan view of a slotted disc;

FIG. 5 is a fragmentary cross section through a part of a disc after the ridges have been formed and prior to the grinding step; and FIG. 6 is a view similar to FIG. 5 but showing the slots after grinding.

Referring now to the drawings in which like reference numerals denote similar elements, FIG. 1 shows an electric razor incorporating the invention. Although the invention is adaptable to different types and kinds of razors, for purposes of illustration it is shown as it could be embodied in a Norelco electric razor 2 having a shaving head 4 in which are disposed three discs 6 having annular side skirts 8, and flat tops 10 having an array of slots 12 bounded by sharp edges 14. The slots can be arranged in various patterns, for example, such as to extend radially and tangentially as illustrated in FIGS. 1 and 4. They are narrow, on the order of a few hundredths of an inch in width, and bounded by sharp edges 14.

One method for forming the sharp-edge slots is illustrated in FIGS. 5 and 6. Small flat-top ridges 16 are formed in the disc metal, preferably while it is still relatively soft, leaving lands 18 between the ridges. In FIG. 5, it will be seen that the bottom surfaces 16A of the ridges are co-planar, or nearly so, with the top surfaces 18A of the lands, and between the bottom surfaces 16A of the ridges and bottom surfaces 18A of the lands the metal rises along inclines 14A. Thus, when the ridges 16 are ground off, this leaves the slots 12 with the lands 18 therebetween and the sharp edges 14 at the top of the inclines, or bevels 14A. Then the metal can be hardened and tempered in accordance with standard blade-forming techniques and honed.

FIG. 2 shows the eccentric drive for discs 6. A drive pinion 20, powered by a suitable electric or spring motor, drives gears 22 in which are splined posts 24 so that the posts rotate with the gears. On the tops of posts 24 are eccentric balls 26 over which engage spring sockets 28, the latter being welded on the undersides of discs 6. Suitable bearings 32 and 34 rotatably support posts 24 and gears 22. The openings 30 in head 4 which accommodate the annular skirts 8 of discs 6 are sufficiently oversize so that the discs are free to undergo an orbital motion when eccentric balls 28 on posts 24 are rotated. The motion of the sharp edges 14 of slots 12 is illustrated, with exaggeration, in FIG. 3. From this it is apparent that the orbital motion produces a slicing motion, first in one direction and then the other. Although any given point along the slot edge partakes of the eccentric motion of ball 28, discs 6 do not rotate. The friction between the user's face and the surface of the disc militates against rotation of the disc. If desired, suitable means, not shown, can be utilized to prevent disc rotation.

The discs are driven in minutely eccentric motion to afford a variable slicing action. The rate and degree of the eccentric motion is determined by the ratio of the gear train, for example, on the order of twenty times per second, and the eccentric range, determined by ball eccentricity, should be equal to or slightly greater than the width of the razor slots. Because of the dual or two-way characteristics of the slicing actions, each hair will be subject to two slicing episodes in opposite directions, thereby eliminating chisel-shaped hair endings to which have been attributed inflammation and possible infection. This slicing action approximates the technique employed by an experienced barber using a straight razor. With the subject type razor, the likelihood of accidental incision is virtually nil.

Referring to FIG. 1, let it be assumed that there are 32 slots, each 3/32 of an inch long on each disc. Taking into account the dual-edged nature of the slots, and with three such discs, this provides an active shaving length of a total of 18 inches for the three discs.

I claim:

1. In a razor, a shaving head, at least one generally flat planar disc moveably mounted in said head and having a plurality of apertures therethrough bounded by sharp edges, and means for imparting an orbital motion to said disc relative to said head in the plane of said disc, whereby said sharp edges slice through hairs projecting through said slots from a skin surface against which said disc is engaged, characterized in that the hair-cutting action of said razor is due entirely to the slicing of said sharp edges through the hairs.

2. A razor as claimed in claim 1, said apertures comprising narrow elongate slots.

3. A razor as claimed in claim 2, the extremity of orbital motion being substantially equal to or slightly greater than the maximum width of said slots.

4. A razor as claimed in claim 3, the width of said slots being on the order of a few hundredths of an inch.

5. A razor comprising a head having a wall, a generally flat planar disc loosely disposed in an opening in said wall and adapted for one flat side thereof to be engaged against the surface to be shaved, a plurality of apertures through the disc bounded by sharp edges on opposite sides of the apertures, drive means for moving said disc relative to said wall about an orbit approximately equal to or slightly greater than the distance between said opposed sharp edges, said drive means comprising a socket on the other flat side of the disc, a post disposed substantially normal to the plane of the disc, an eccentric ball on the end of said post and engaged in said socket and means for rotating said post.

6. A razor as claimed in claim 5, said apertures comprising slots and said sharp edges being on opposite longitudinal edges of the slots.

7. A razor comprising a head having a wall, a generally flat planar disc loosely disposed in an opening in said wall and adapted for one flat side thereof to be engaged against a skin surface to be shaved, a plurality of apertures through said disc bounded by sharp edges, and means for imparting an orbital motion to said disc relative to said wall whereby said sharp edges slice through hairs projecting through said apertures from the skin surface.

* * * * *